US005146711A

United States Patent [19]

Gallenschütz et al.

[11] Patent Number: 5,146,711

[45] Date of Patent: Sep. 15, 1992

[54] SECURITY REVOLVING DOOR

[75] Inventors: Thomas Gallenschütz, Bühl/Baden; Hermann Vogel, Bühlertal; Erwin Hochstuhl, Bühl, all of Fed. Rep. of Germany

[73] Assignee: Gallenschütz Metallbau GmbH, Bühl/Baden, Fed. Rep. of Germany

[21] Appl. No.: 666,238

[22] Filed: Mar. 8, 1991

[30] Foreign Application Priority Data

Mar. 9, 1990 [DE] Fed. Rep. of Germany ..... 4007303

[51] Int. Cl.[5] ..... E06B 11/08

[52] U.S. Cl. ..... 49/46; 49/35

[58] Field of Search ..... 49/13, 35, 42, 46, 47, 49/49

[56] References Cited

U.S. PATENT DOCUMENTS

| | | | |
|---|---|---|---|
| 1,221,268 | 4/1917 | Andreatte | 49/35 |
| 1,617,918 | 2/1927 | McLaughlin | 49/47 |
| 1,623,744 | 4/1927 | McLaughlin | 49/35 X |
| 1,688,746 | 10/1928 | Parson | 49/35 X |
| 2,312,340 | 3/1943 | Kilpatrick | 49/35 X |
| 2,714,264 | 8/1955 | Odell | 49/35 |
| 3,397,486 | 8/1968 | Foxwell et al. | 49/35 X |
| 3,445,962 | 5/1969 | Bylard et al. | 49/47 |
| 3,978,613 | 9/1976 | Hayward et al. | 49/47 X |
| 3,998,008 | 12/1976 | Colles | 49/47 |

*Primary Examiner*—Renee S. Luebke

*Assistant Examiner*—Jerry Redman

*Attorney, Agent, or Firm*—McGlew & Tuttle

[57] ABSTRACT

In a security revolving door is provided (1) with a turnstile (2) rotatably through one passage sector (8) and one blocking sector (9), which turnstile can be turned into a defined resting position. An electronic control unit (28) with peripheral monitoring devices is provided to control a blocking device (14) releasing or blocking the rotation of the turnstile (2). The blocking device (14) consist of the simplest possible, identical individual parts, which can be simply adjusted or readjusted to different cases of application and modes of operation. This is achieved by the blocking device (14) having a blocking member (15) which is connected nonrotatably to the turnstile (2). The blocking member is provided with blocking cams (18, 19, 20), whose number corresponds to the number of the cross wings (4, 5, 6), and is associated with two electromagnetically controllable blocking elements (16, 17). One of the blocking elements (16) brings about blocking of the counterclockwise rotation (arrow 22) in cooperation with a blocking cam (18, 19, 20), and the other blocking element (17) brings about blocking of the clockwise rotation (arrow 23) in cooperation with another blocking cam (18, 29, 20), wherein the blocking elements (16, 17) can be mechanically deflected from their blocking position from the blocking cams (18, 19, 20) in the opposite direction of rotation.

7 Claims, 5 Drawing Sheets

SECURITY REVOLVING DOOR

FIELD OF THE INVENTION

The present invention pertains to a security revolving door with a turnstile which rotates through one passage sector and one blocking sector, has at least two and especially three cross wings, can be rotated optionally in one direction or both directions, and can be rotated into a defined resting position at the end of each passage by a mechanical or electrical drive, wherein the passage sector is radially delimited by a stationary housing part which extends over a central angle which is approximately equal to or smaller than the angular distance between two successive cross wings, and wherein an electronic control unit with peripheral monitoring devices is provided to control a blocking device releasing or blocking the rotation of the turnstile.

BACKGROUND OF THE INVENTION

Turnstiles are known to differ from revolving doors in that they do not have full-surface door wing leaves, but cross wings consisting of a plurality of bar-shaped or plate-shaped members arranged in one plane one on top of another, which members are arranged at vertically spaced locations from each other, so that they are able to pass through a stationary blocking grid delimiting the blocking sector.

The cross wings can be driven manually or by a motor. However, it is required in any case that the cross wings be moved into a defined starting position and be blocked there after one passage.

To enable such turnstiles to be used as security revolving doors, it is necessary to provide, besides an electrical or electronic control unit with peripheral monitoring devices, e.g., card readers, space sensors, etc., a blocking device with electrically controllable blocking members, which blocking device makes it possible to block the turnstile against rotation optionally in one rotation direction and/or in the other rotation direction in defined angular positions, and it also must be ensured at the same time that the rotation blocking acts in one direction only and the turnstile can be turned back into its starting position in the opposite direction. In addition, depending on the particular application, it must be possible to impose specifically defined characteristics on the blocking device in the case of power failure, so that the turnstile is, for example, freely rotatable or blocked in both directions, or is blocked in one direction only. In any case, it must be guaranteed that a person located in the passage sector cannot be locked in by the rotation blocking of the turnstile.

SUMMARY AND OBJECTS OF THE INVENTION

It is an object of the present invention to provide a blocking device which can be adjusted or readjusted to different applications by using possibly identical parts for a security revolving door of the class described in the introduction, using the simplest possible, easy-to-install parts.

This task is accomplished according to the present invention in that the locking device has a blocking member connected nonrotatably to the turnstile, which blocking member is provided with blocking cams with left and right stop faces acting in opposite directions. The number of blocking cams corresponds to the number of cross wings, and is associated with two electromagnetically controllable blocking elements, especially catches or locking bolts, such that one of the blocking elements, cooperating with the left stop face of a blocking cam, brings about rotation blocking in the counterclockwise direction, and the other blocking element, cooperating with the right stop face of another blocking cam, brings about rotation blocking in the clockwise rotation direction.

Using such a blocking device, which requires only two mutually independent electromagnets and two catches, it is possible to have each turnstile assume the function of a security revolving door and to meet the above-described conditions. It is also possible without extensive modifications to provide electromagnetically actuated, pneumatically or hydraulically operating drives to actuate the blocking elements, which can be especially advantageous when large forces are needed for actuation. Using the same parts, it is also possible to achieve different modes of operation, especially in terms of the blocking characteristics in the currentless state, by arranging these parts differently.

Even though it is basically possible to bring the blocking elements into or out of the blocking position by correspondingly energizing the electromagnets associated with them so that both of them cannot be active at the same time, the embodiment of the present invention including positioning blocking faces outside a path of rotation of blocking cams and arranged such that in the blocking position relative to the turnstile axis the blocking faces have a blocking angular distance from each other that is greater than the angular distance of the mutually opposite stop faces of the blocking cams, also guarantees the advantage that this condition will continue to be met even in the case of failure of the electromagnets and especially in the case of power failure in that the two blocking elements are mechanically prevented from simultaneously dropping into the blocking position and becoming active. It is thus ensured that the turnstile can be rotated from each blocking position against the blocked direction to such an extent that a person located in the passage sector will be able to leave this sector and cannot be locked in.

In the case of a turnstile with a different diameter, the angular difference specified between the blocking angular distance and the angular distance of the stop faces of the blocking cams in a range of from 2° to 5°, may be selected to be greater or smaller.

The embodiment providing a door gap with a maximum width between the exit-side delimiting edge of the housing part and the respective adjacent cross wing in the blocking position of the turnstile caused by the blocking element in the passage direction, ensures that passage of an unauthorized person will be prevented in both directions, because the exit- side door gap existing in the blocking positions of the turnstile permits neither exit from or entry into a passage sector.

The embodiment of the invention including blocking elements provided with deflecting surfaces extending obliquely to the path of rotation for deflecting the blocking elements from their blocking positions for rotation opposite the blocking direction, makes it possible to design the control of the blocking elements or their electromagnets such that the catches assume their blocking position in their resting position, i.e., when the electromagnets are not energized, and that the blocking device exerts its blocking effect only in one or the other preferred direction or in both rotation directions even in the case of power failure.

The embodiment of the invention including blocking elements designed as catches with two coupling fingers offset by approximately 90° relative to their bearing access for coupling with an armature of an electromagnet, makes it possible to achieve the advantages of the embodiment including the deflecting surfaces provided for the blocking elements being deflected from the blocking position in one or both directions of rotation, even with locking bolts acting as the blocking elements.

The embodiment of the invention including blocking elements designed as locking bolts having a wedge surface on their front sides engaging the blocking cams to form an acute angle with the blocking surface, makes it possible to energize the catches such that they are in the blocking position when the electromagnets are energized, or when the electromagnets are not energized, i.e., the same catches can be set for both control modes.

Embodiments of the present invention will be explained below in greater detail based on the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE INVENTION

Figure 1:
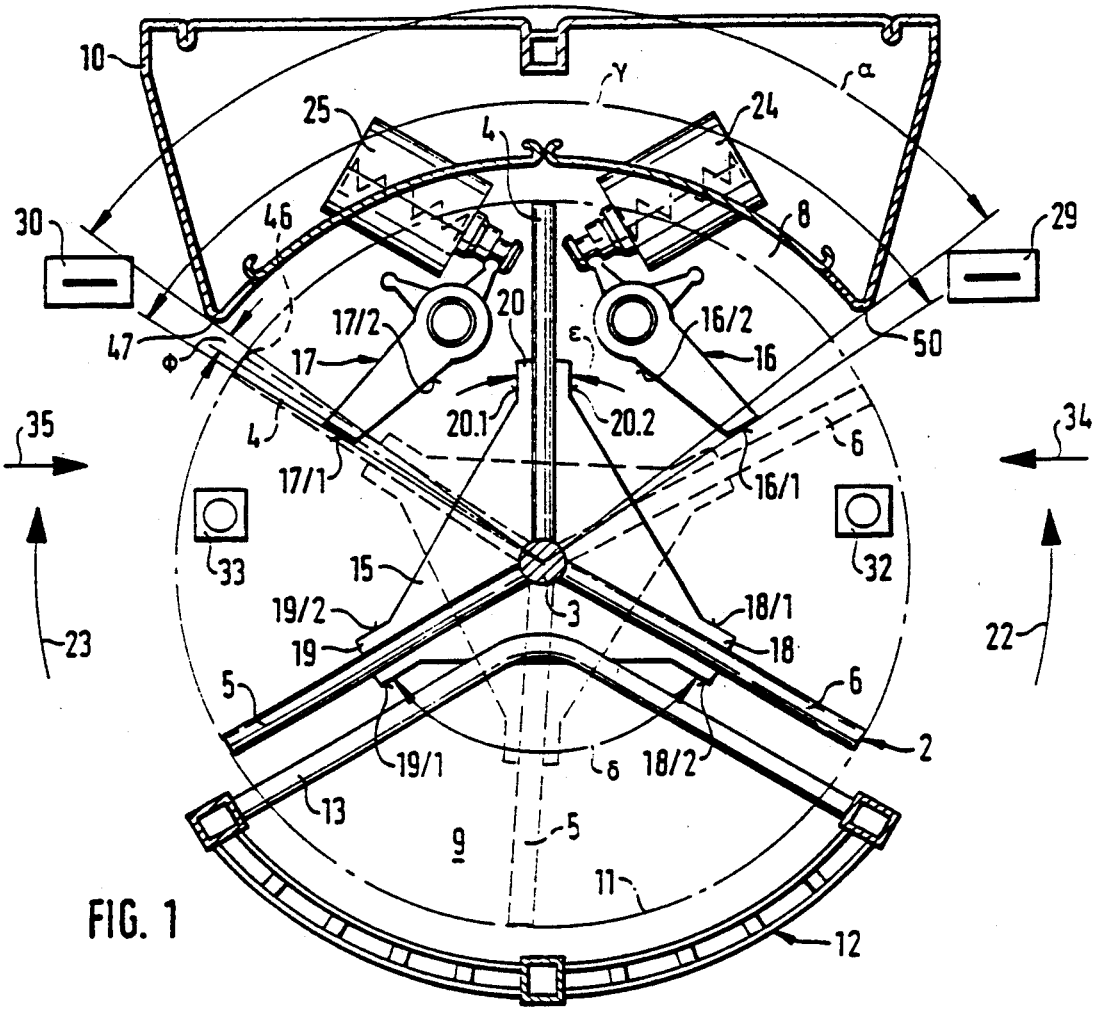
FIG. 1 is a schematic top view of a three-wing turnstile with housing part, blocking grid, and the schematic arrangement of a blocking device in the resting position.

FIG. 1 shows schematically a security revolving door 1, which has a three-wing turnstile 2 with three rotary wings 4, 5, and 6, which are offset relative to one another through 120° and extend radially to the axis of rotation 3. The rotary wings 4, 5, and 6 consist, in the known manner, of individual tubes or bars extending in the horizontal direction, which are connected to a rotary shaft 7 in the vertical plane and are vertically spaced from each other by a distance corresponding approximately to 1.5 times their diameter.

The security revolving door 1 has one passage sector 8 and one blocking sector 9. The passage sector 8 is delimited radially by a circular concave housing part 10, which has a central angle alpha of ca. 100° and is arranged at a small radial distance from the circle of rotation 11 defined by the rotary wings 4, 5, and 6. The blocking sector 9 is defined in the known manner by a sector-like blocking grid 12, through which the tubes or bars of the rotary wings pass during the rotation of the turnstile 2.

The security revolving door 1 is also provided with a blocking device 14, which consists of a blocking member 15 and two electromagnetically controllable catches 16 and 17, which are energized via a peripheral monitoring device.

The blocking member 15 is nonrotatably connected to the turnstile 2 and provided with blocking cams 18, 19, and 20, whose number corresponds to the number of the rotary wings 4, 5, and 6 of the turnstile 2; the blocking cams have left stop faces 18/1, 19/1, 20/1 and right stop faces 18/2, 19/2, and 20/2 acting in opposite directions.

The catches 16 and 17 are pivotably mounted outside a path of rotation 21 of the blocking cams 18, 19, and 20, and are associated with the stop faces 18/1-18/2, 19/1-19/2, 20/1-20/2 such that one catch 16 brings about rotation blocking in the counterclockwise rotation direction 22 by means of its blocking face 16/1 with the left stop face 18/1, 19/1, and 20/1 of the blocking cam 18, 19, 20, and that the other catch 17 brings about rotation blocking in the clockwise rotation direction 23 by means of its blocking face 17/1 in cooperation with the right stop faces 18/2, 19/2, and 20/2 of a respective blocking cam 18, 19, 20. The catches 16 and 17 are also arranged such that in the respective blocking position relative to the turnstile axis 3, the blocking faces 16/1, 17/1 of the catches 16 and 17 are spaced from each other by a blocking angular distance gamma ($\gamma$) that is ca. 10° greater in the examples shown than the central angle alpha ($\alpha$) of the housing part 10. The blocking angular distance gamma ($\gamma$) is ca. 2° to 5° greater than the angular distance delta ($\delta$) formed between the corresponding left stop face 18/1, 19/1, 20/1 of one blocking cam 18, 19, 20 and the corresponding right stop face 18/2, 19/2, 20/2 of the adjacent blocking cam 18, 19, 20. To prevent both catches 16, 17 from acting simultaneously, the blocking angular distance gamma ($\gamma$) must always be greater than the angular distance delta ($\delta$).

Figure 2:
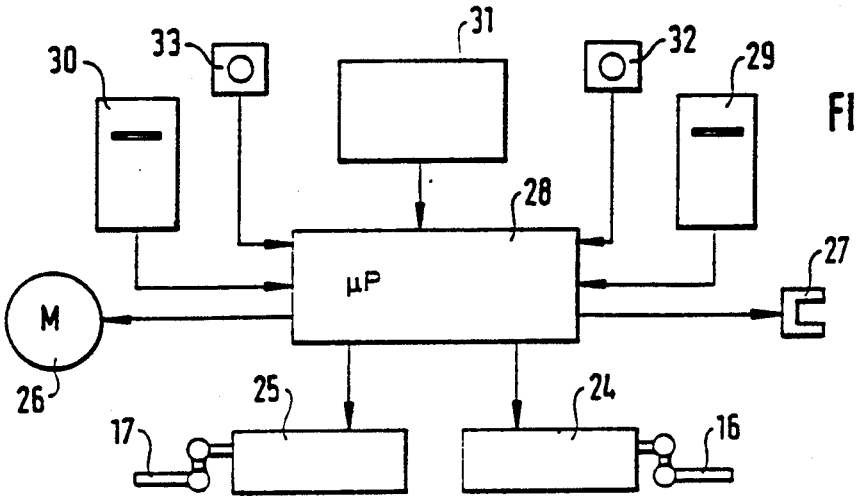
FIG. 2 is a simplified circuit diagram of a control device.

To actuate the catches 16, 17, two spring-tensioned solenoid plunger magnets 24, 25 are provided, which are arranged differently and are able to act differently. The solenoid plunger magnet 24 arranged on the right-hand side in FIGS. 3 through 13 actuates the catch 16 for blocking the counterclockwise rotation 22, and the solenoid plunger magnet 25 arranged on the left-hand side in this case actuates the catch 17 for blocking the clockwise rotation 23. The two solenoid plunger magnets 24, 25 are in turn energized by a switching device including a microprocessor, which is part of a monitoring device (FIG. 2), which also comprises an electric motor 26 driving the turnstile 2 and an electromagnetic braking device 27 and—as peripheral control devices—two card readers 29, 30, a position transducer 31, as well as at least one sensor 32, 33 in the area of the entry openings 34, 35 of the security revolving door. The card readers 29, 30 are arranged readily accessibly outside the entry openings 34, 35 (FIG. 1). The sensors 32, 33 are usually arranged on a ceiling (not shown in the drawing) connecting the housing part 10 and the blocking grid 12.

The catches 16 and 17, which are of fully identical design, each consist of a blocking arm 36 and 37, respectively, and two coupling fingers 38 and 40 as well as 39 and 41, respectively, and the coupling fingers 38 and 39 extend at right angles to the coupling fingers 40 and 41, respectively.

The solenoid plunger magnets 24 and 25, which are also of identical design, each have a cylindrical solenoid plunger 42 and 43, respectively, which is provided at its free end with a respective circumferential groove 44 and 45, into which the coupling fingers 38 and 40 as well as 39 and 41, respectively, extend in a positive-locking manner, for coupling with the respective coupling fingers 38, 40 and 39, 41, respectively, of a catch 16 and 17, respectively. The respective catches 16 and 17 are arranged and mounted such that the blocking arms 36, 37 can be optionally pivoted into or out of the path of rotation 21 of the blocking cams 18, 19, 20.

Due to diametrical or perpendicular arrangement of the coupling fingers 38, 39 and 40, 41, respectively, of the respective catches 16 and 17 relative to the respective blocking arms 36 and 37, and due to the optional coupling of the respective solenoid plunger 42 and 43 with one of the coupling fingers 38, 40 and 39, 41, respectively, it is possible to select different variants in terms of the behavior of the blocking device of the security revolving door 1 in the currentless state of the spring-tensioned solenoid plunger magnets 24 and 25, respectively.

Figure 3:
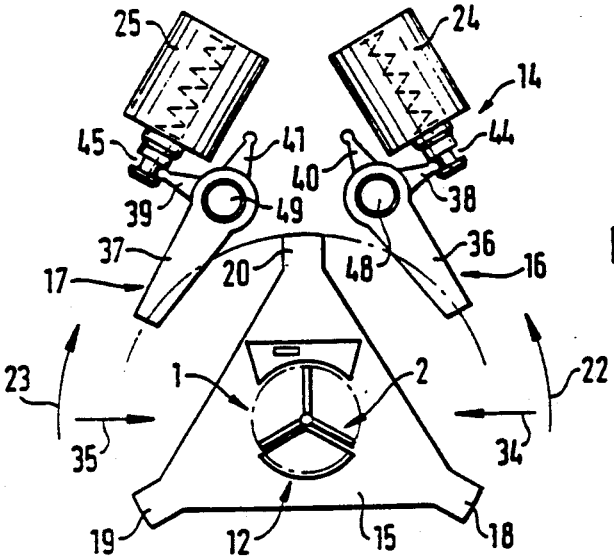
FIG. 3 is an enlarged top view of a blocking device in the blocked position of both catches.

As is apparent from FIG. 3, when the solenoid plunger 42 or 43 of the solenoid plunger magnet 24 or 25 is coupled with the respective coupling finger 38 and 39, which is arranged at right angles to the blocking arm 36 and 37, respectively, both catches 16 and 17 are in the blocking position in the currentless state of the solenoid plunger magnets 24 and 25, respectively. The security revolving door shown on a smaller scale within the blocking member 15 in FIGS. 3 through 13 is in the resting position in FIG. 3.

The catches 16, 17 are also provided with respective deflecting faces 16/2 and 17/2 extending obliquely to the path of rotation 21 of the blocking cams 18, 19, 20. The deflecting faces provide a surface such that the catches can be automatically deflected from their blocked position during the turning past of a blocking cam 18, 19, 20.

Figure 4:
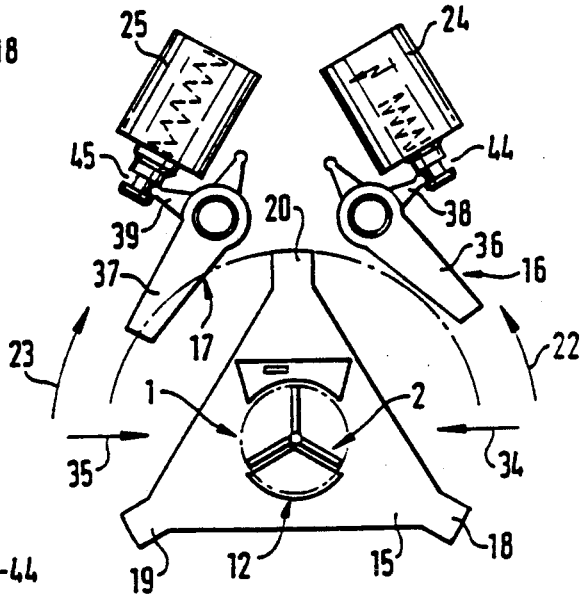
FIG. 4 is a top view of the blocking device according to FIG. 3 in the released position for counterclockwise rotation.
Figure 5:
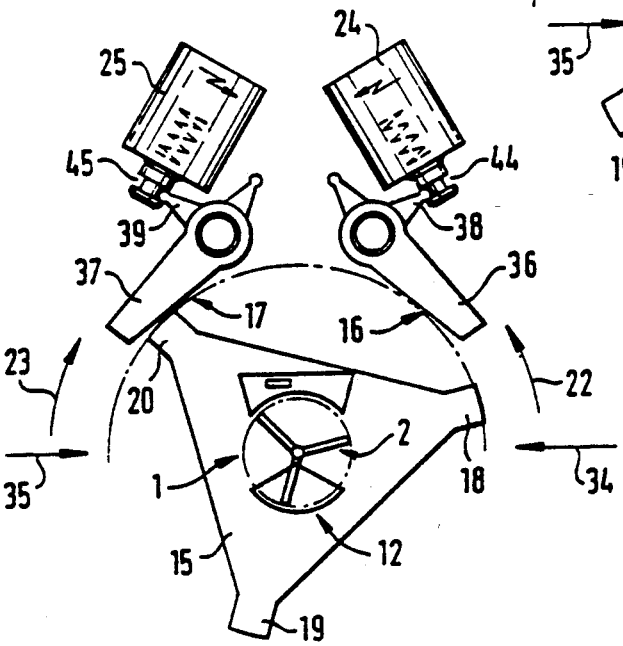
FIG. 5 is a top view of the blocking device according to FIG. 3 in the other functional position.
Figure 11:
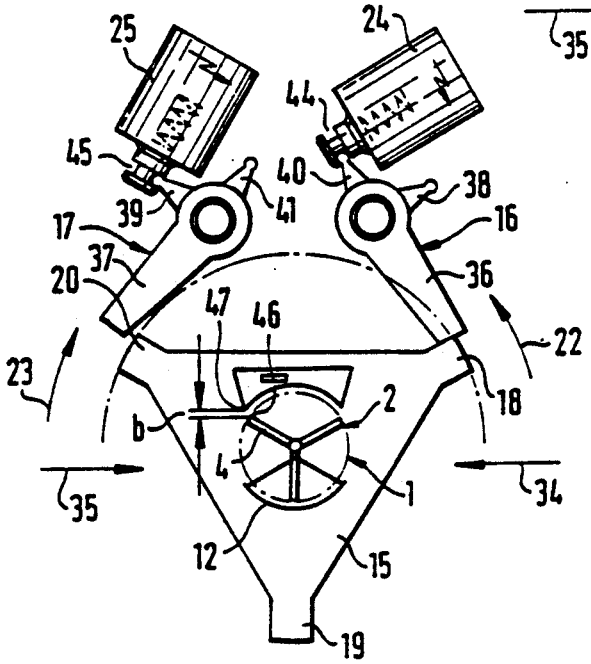
FIG. 11 is a to view of the blocking device according to FIG. 10 in another functional position.

During the operation, the right solenoid plunger magnet 24 pulls the catch 16 out of its blocked position when an authorized person enters the security revolving door 1 from the right entry side 34, so that the turnstile 2 can be freely rotated in the counterclockwise direction (FIG. 4). The turnstile 2 is rotated in the counterclockwise direction 22, and the blocking cam 20 moving against the deflecting face 17/2 deflects the catch 17 from its blocked position, as is apparent from FIG. 5. FIG. 5 shows the position after counterclockwise rotation of the turnstile through 45°. However, if an unauthorized person is detected in the passage sector 8 by the existing sensor system, the catch 16 will remain in its blocked position shown in FIG. 3 until the blocking cam 18 strikes it, as shown in FIG. 11, and the turnstile will stop after turning through ca. 58°. In this position (see FIG. 11), the outer edge 46 of the cross wing 4 is located at a maximum distance of 130 mm from the vertical delimiting edge 47 of the housing part 10, in order to interdict passage to an unauthorized person. The command to hold the catch in its blocked position may also be issued by a source other than the sensor system. However, when an authorized person is passing through, the catch 16 is pivoted out, and the turnstile 2 is not prevented from rotating in the counterclockwise direction.

After each stop of the turnstile 2 in a blocked position defined by one of the catches 16, 17, the turnstile is turned by a motor into the next possible resting position.

Figure 6:
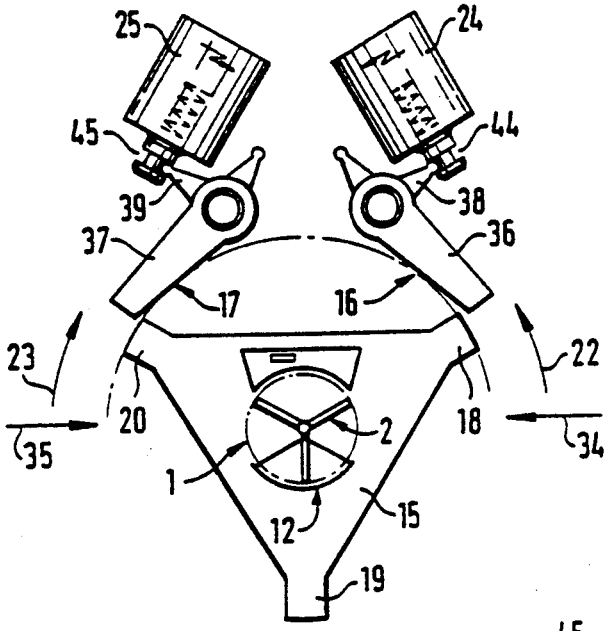
FIG. 6 is a top view of the blocking device according to FIG. 3 after counterclockwise rotation through ca. 60°.

As is apparent from FIG. 6, dropping in or blocking of one of the two catches 16 and 17 is not possible in the case of counterclockwise rotation of the turnstile through 60°. The catch 17 drops back into its blocking position, i.e., into its starting position, in the currentless state of the left solenoid plunger magnet 25 only after the turnstile 2 has been rotated in the counterclockwise direction through ca. 62°, and blocks the turnstile 2 against clockwise rotation in direction 23, so that the turnstile 2 is no longer able to be turned back (FIG. 7).

Figure 7:
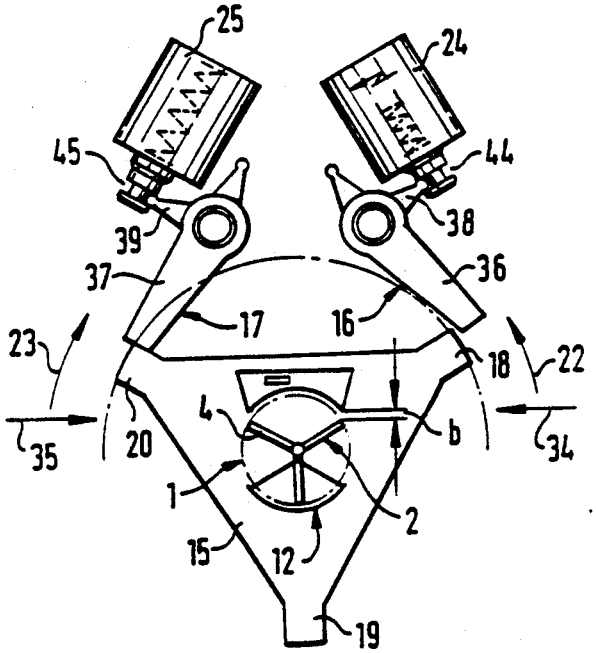
FIG. 7 is a top view of the blocking device according to FIG. 3 after counterclockwise rotation through 62°.

According to FIG. 7, in this blocked position in the clockwise rotation direction 23, after counterclockwise rotation 22 through 62°, the distance b between the vertical outer edge 46 of the rotary wing 4 and the vertical delimiting edge 47 of the housing part 10 is also 130 mm, maximum, in order to prevent an unauthorized person from entering on this side. After the catch 17 drops into this blocking position, in which the turnstile 2 is prevented from rotating in the clockwise direction 23, the passage of one person is practically complete. A signal reporting the passage to the monitoring device brings about interruption of the power supply to the solenoid plunger magnet 24. The blocking arm 36 of the catch 16 first drops onto the blocking cam 18, and after further counterclockwise rotation of the turnstile 2 into its resting position after a total angle of rotation of 120° in the counterclockwise direction, the catch 16 drops back into its starting position, i.e., into the blocked position. Passage is reported when the catch 17 has dropped into the blocking position behind the blocking cam 20, so that the turnstile 2 is blocked against turning back.

Figure 8:
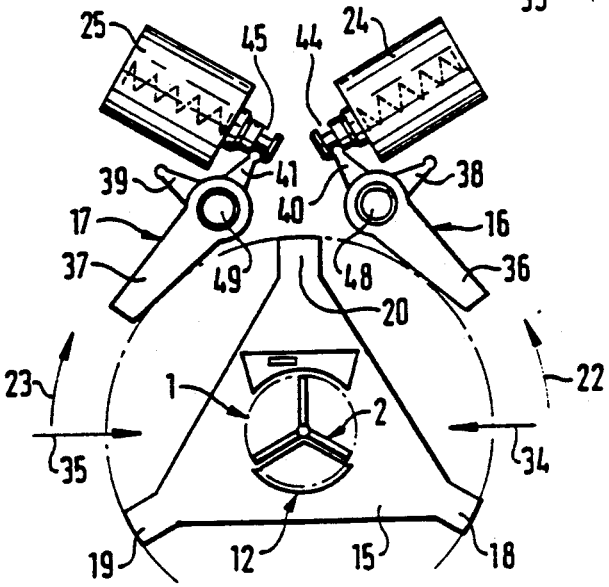
FIG. 8 is a top view of a blocking device in the resting position with another arrangement of the solenoid plunger magnets.
Figure 9:
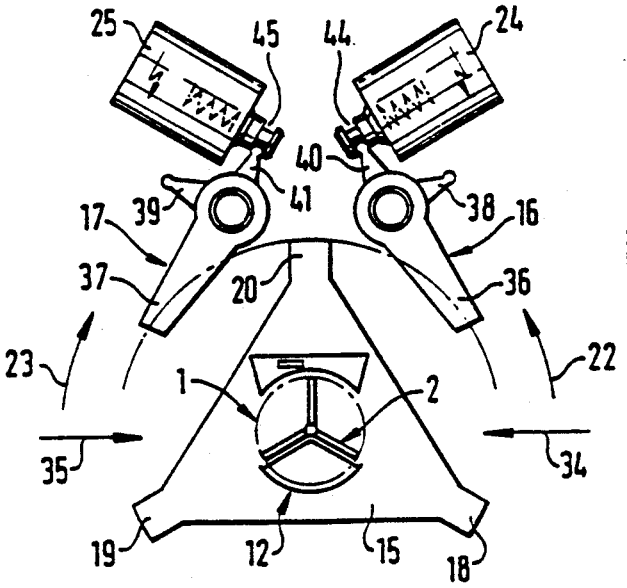
FIG. 9 is a top view of the blocking device according to FIG. 8 with both catches in the blocking position.

One variant of an arrangement of the solenoid plunger magnets 24, 25 is shown in FIG. 8 and FIG. 9. In this arrangement of the solenoid plunger magnets 24, 25, the solenoid plungers 42, 43 and the respective magnets are coupled via their grooves 44, 45 with the coupling fingers 40, 41 of the catches 16, 17, so that the catches 16, 17 are in the swung-out, i.e., non-blocking position in the currentless state of the solenoid plunger magnets 24, 25. The turnstile 2 is consequently freely rotatable in both directions 22 and 23. To achieve the same starting state, i.e., permanent blocking in both directions, as in the case of the arrangement according to FIG. 3, the two solenoid plunger magnets 24, 25 are to be put into the energized state according to the representation in FIG. 9. This can happen when an unauthorized person enters the passage sector 8. The turnstile 2 is blocked in both directions after rotating through ca. 58°.

When an authorized person enters the security revolving door 1 through the entry opening 34 or 35, a stay magnet 24, 25 is energized, depending on the direction of passage, such that after turning through ca. 62°, the turnstile 2 is prevented by the actuated catch 16 or 17 from turning back.

Figure 10:
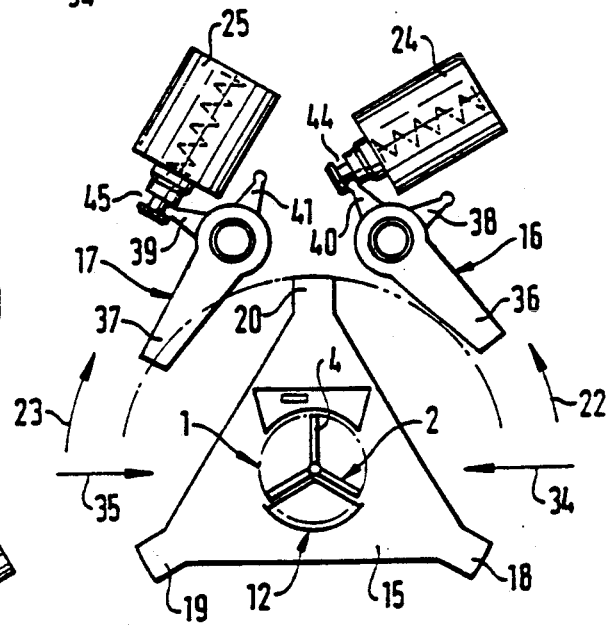
FIG. 10 is a top view of another blocking device in the resting position with another arrangement of the solenoid plunger magnets.

FIG. 10 and FIG. 11 show another variant of the arrangement of the solenoid plunger magnets 24, 25, in which the solenoid plunger magnet 24 is coupled via the groove 40 of its solenoid plunger 42 with the coupling finger 40 of the catch 16, which the coupling finger is opposite the blocking arm 36, and the solenoid plunger magnet 25 is coupled with the groove 45 of its solenoid plunger 43 with the coupling finger 39 of the catch 17, which the coupling finger is at right angles to the blocking arm 37. To release the turnstile 2 in the counterclockwise direction 22, the solenoid plunger magnet 24 is currentless, whereas the solenoid plunger magnet 25 is energized for release in the clockwise direction 23, so that the respective catch 16 or 17 is in the swung-out, non-blocking position in these cases.

In this arrangement of the solenoid plunger magnets 24, 25, the turnstile 2 is always free to rotate in the counterclockwise direction 22 and is blocked in the clockwise direction 23 in the resting state. By simultaneously energizing both of the solenoid plunger magnets 24 and 25, the direction in which free rotation is possible is reversed, because the catch 16 is in the blocking position and the catch 17 is swung out.

If an unauthorized person enters the passage sector 8 in the resting state from the right via the entry opening 34, the solenoid plunger magnet 24 is energized, and counterclockwise rotation 22 of the turnstile 2 is possible only until the left stop face 18/1 of the blocking cam 18 strikes the blocking arm 36, i.e., only through 58°. During this counterclockwise rotation 22, the blocking arm 37 is radially deflected by the blocking cam 20. However, due to the blocking member 15 being blocked in the counterclockwise direction 22, the catch 17 is unable to drop back into the blocking position, but it lies on the outside of the blocking cam 20. The turnstile 2 can thus be turned back in the clockwise direction 23, so that the unauthorized person is unable to leave the security revolving door 1 through the entry opening 34.

Figure 12:
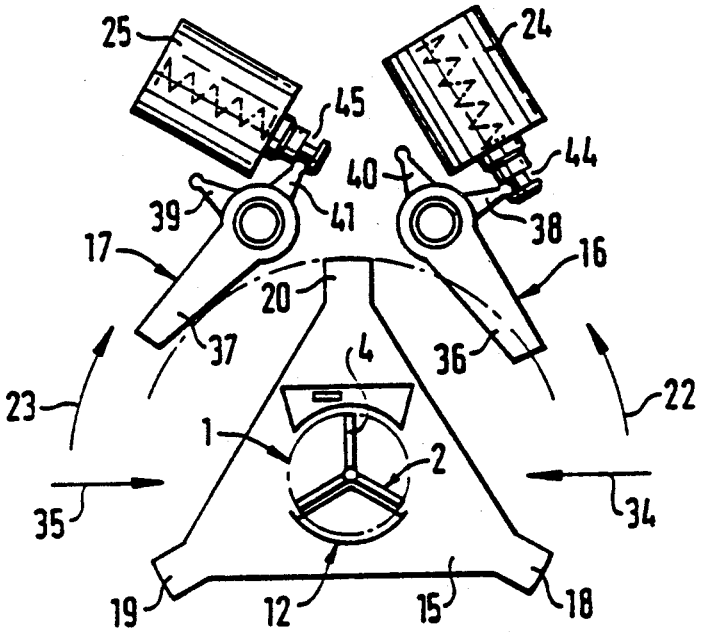
FIG. 12 is a top view of a blocking device in the resting position with another variant of arrangement of the solenoid plunger magnets.
Figure 13:
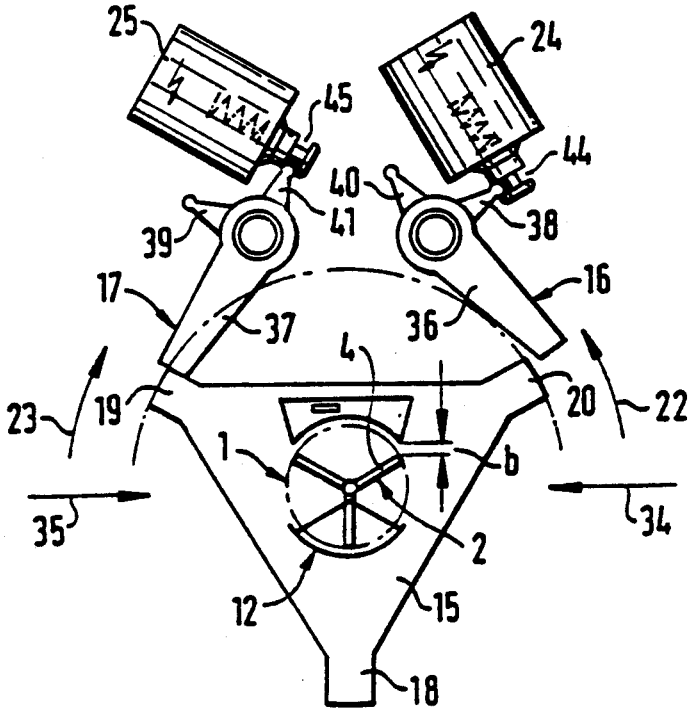
FIG. 13 is a top view of the blocking device according to FIG. 12 in another functional position.

FIGS. 12 and 13 show yet another variant of arrangement, in which the solenoid plunger magnet 24 is coupled via the groove 44 of its solenoid plunger 42 with the coupling finger 38 of the catch 16, which coupling finger 38 is at right angles to the blocking arm 36, and the solenoid plunger 25 is coupled via the groove 45 of its solenoid plunger magnet 43 with the coupling finger 41 of the catch 17 located opposite the blocking arm 37.

In this arrangement, rotation of the turnstile 2 in the clockwise direction 23 is always free and blocked in the counterclockwise direction 22 in the resting state. Analogously to the example shown in FIGS. 10 and 11, release in the opposite rotation direction can be achieved by simultaneously energizing the two solenoid plunger magnets 24 and 25.

In the non-energized state of the solenoid plunger magnets 24 and 25, the catch 16 is in the blocking position for counterclockwise rotation, and the catch 17 is in the swung-out, i.e., inactive position for clockwise rotation (FIG. 12).

However, if an unauthorized person enters the passage sector 8 in the resting state via the entry opening 35, the solenoid plunger magnet 25 is energized, and rotation of the turnstile 2 in the clockwise direction 23 is possible only through 58° until the right stop face 19/2 of the blocking cam 19 strikes the blocking arm 37. During this clockwise rotation 23, the catch 16 is radially deflected from the blocking cam 20. Due to the rotation of the blocking member 15 being limited, the catch 16 is unable to drop back into the blocking position, but it lies on the outside of the blocking cam 20. The turnstile 2 can thus be turned back in the counterclockwise direction 22, so that the unauthorized person is able to leave the passage sector 8 through the entry opening 35, through which he entered.

The above-described examples show that by arranging the two catches 16 and 17 and their solenoid plunger magnets 24 and 25 according to the present invention, and due to their cooperation with the blocking member 15, various types of highly effective passage control can be performed in a simple manner and with a small amount of effort, and that the blocking device can be changed over to different blocking characteristics in a very simple manner with the identical individual parts. It is also obvious that the energization of the blocking elements for blocking or releasing the turnstile is not bound to specific control programs.

While a specific embodiment of the invention has been shown and described in detail to illustrate the application of the principles of the invention, it will be understood that the invention may be embodied otherwise without departing from such principles.

What is claimed is:

1. A security revolving door arrangement, comprising:

a turnstile including at least two cross wings;

passage sector means surrounding and defining a passage sector on one side of the turnstile, said passage sector means including a stationary housing part which extends over a central angle which is approximately equal to or smaller than an angular distance between two successive cross wings;

blocking sector means surrounding and defining a blocking sector at a side of said turnstile opposite to said passage sector;

a blocking device including a blocking member connected non-rotatably to said turnstile, said blocking member including blocking cams with a first side stop face and a second side stop face, the number of cams corresponding to the number of cross wings of the turnstile;

two electromagnetically controlled blocking arms, said blocking arms being moveable into and out of engagement with the first and second stop faces, one blocking arm engaging the first stop face of a blocking cam for blocking counterclockwise rotation and the other blocking arm engaging with the second stop face of a blocking cam for blocking clockwise rotation, each of said blocking arms is designed as a catch having two coupling fingers offset by substantially 90° relative to a bearing access, one of said coupling fingers being optionally coupled with an armature of an electromagnet of said electromagnetic drive means, whereby the coupling of one or another of said coupling fingers changes the orientation of the associated blocking arm; and electronic control means including peripheral monitor devices for controlling the blocking arms for releasing or blocking the rotation of the turnstile.

2. A security revolving door arrangement comprising:

a turnstile having a central substantially vertical rotary axis, said turnstile having at least three rotary wings extending radially from said central vertical rotary axis, and said turnstile being rotatable about said central substantially vertical rotary axis and having a plurality of resting positions;

a housing part positioned along a circumferential edge of said rotary wings, said housing part and said turnstile defining a passage sector, said housing part radially limiting said passage sector, said rotary wings being rotatable through said passage sector, said passage sector extending over a central angle which is smaller than an angle between said rotary wings;

a blocking grid positioned along another circumferential edge of said rotary wings, said blocking grid and said turnstile forming a blocking sector through which passage is blocked, said rotary wings being rotatable through said blocking sector;

drive means for returning said turnstile to one of said plurality of resting positions after said turnstile has been rotated away from one of said plurality of resting positions, one of said rotary wings being located in a center of said passage sector when said turnstile is in one of said plurality of resting positions;

a blocking member joined rigidly with said turnstile and being rotatable with said turnstile, said blocking member having a number of blocking cams equal to a number of said rotary wings, said blocking cams being spaced apart by an angular distance substantially equal to said angle between said rotary wings, each of said blocking cams having a first and a second stop surface;

first and second blocking catch means for interacting with said blocking cams, said first and second blocking catch means having a blocking surface moveable between an active position and an inactive position, said blocking surface of said first blocking catching means blocking rotation of said first stop surface in a first direction past said first blocking catch means when said blocking surface is in said active position, said blocking surface of said first blocking catch means moving into said inactive position during rotation of said blocking cams in a second direction, said blocking surface of said second blocking catch means blocking rotation of said second stop surface in a second direction past said second blocking catch means when said blocking surface is in said active position, said blocking surface of said second blocking catch means moving into said inactive position during rotation of said blocking cams in a second direction, said blocking catch means being positioned outside a rotational path of said blocking cams, and said blocking surfaces being moveable into said rotational path of said blocking cams in said active position, said blocking surfaces in said active positions being spaced apart by a blocking angular distance greater than said central angle of said passage sector and also greater than an angular distance delta between said first stop surface of one of said blocking cams and said second stop surface of an adjacent one of said blocking cams;

control means for controlling movement of said first and second catch means, said control means having a microprocessor and peripheral monitoring devices, said peripheral monitoring devices having a card reader, sensors in said passage sector, and a turnstile position indicator.

3. A security revolving door according to claim 2 wherein the difference between the blocking angular distance and the angular distance delta of the stop faces of the blocking cams located next to the blocking arms is substantially 2°–5° at a turnstile diameter of substantially 1 m.

4. A security revolving door according to claim 2 wherein the blocking angular distance, the angular distance delta of the stop faces of the blocking cams and the central angle of the housing part are dimensioned such that a door gap with a maximum width of 130 mm can be formed between and exit-side delimiting edge of said housing part and a respective adjacent rotary wing of said rotary wings in a respective blocking position of the turnstile caused by a blocking arm in a passage direction.

5. A security revolving door according to claim 2, wherein the blocking arms are provided with deflecting surfaces extending obliquely to a path of rotation of the path of the blocking cams, said deflecting faces being deflectable from a blocking position by the blocking cams rotating in a direction opposite to a blocking direction.

6. A security revolving door according to claim 5, wherein each of said blocking arms is designed as a locking bolt having a wedge surface on a front side engaging with the blocking cams, said wedge surface forming an acute angle with the blocking surface of the locking bolt.

7. A security revolving door arrangement comprising:

a turnstile means for causing passage through the security revolving door arrangement by rotation in one of a first and second direction of the turnstile means through a passage angle, said turnstile means having a plurality of rotary wings;

control means for determining in which of said first and second directions said turnstile should rotate;

blocking means for selectively blocking said rotation of said turnstile in one or both of said first and second direction in accordance with said control means, said blocking means at most limiting said rotation of said turnstile to a restriction angle less than said passage angle, said restriction angle being large enough for exiting from the security revolving door arrangement if said rotation of said turnstile means is blocked, said blocking means having a blocking member joined rigidly with said turnstile, said blocking member having a number of blocking cams equal to a number of said rotary wings, each of said blocking cams having a first and second stop surface, said blocking cams being spaced apart by an angular distance substantially equal to said angle between said rotary wings, said blocking means also having first and second blocking catch means for interacting with said blocking cams, said first and second blocking catch means being positioned outside a rotational path of said blocking cams and movable into said rotational path of said blocking cams in order to block said rotation of said turnstile means, said first and second blocking catch means each having a blocking surface, said blocking surface of said first blocking catch means coming in contact with said first stop surface of one of said blocking cams in order to block rotation of said turnstile means in a first direction and said blocking surface of said second blocking catch means coming in contact with said second stop surface of one of said blocking cams in order to block rotation of said turnstile means in a second direction, said blocking surfaces being spaced apart by a blocking angular distance greater than an angular distance between said first stop surface of one of said blocking cams and said second stop surface of an adjacent one of said blocking cams.

* * * * *